US008147102B1

(12) United States Patent
Townes

(10) Patent No.: US 8,147,102 B1
(45) Date of Patent: Apr. 3, 2012

(54) METHOD FOR MOUNTING DECORATIVE LIGHTS

(76) Inventor: Michael William Townes, Phoenix, AZ (US)

( * ) Notice: Subject to any disclaimer, the term of this patent is extended or adjusted under 35 U.S.C. 154(b) by 121 days.

(21) Appl. No.: 12/462,686

(22) Filed: Aug. 6, 2009

Related U.S. Application Data

(63) Continuation-in-part of application No. 11/476,963, filed on Jun. 27, 2006, now abandoned.

(51) Int. Cl.
*F21V 21/00* (2006.01)
*F21V 21/08* (2006.01)

(52) U.S. Cl. ..... 362/396; 362/391; 362/249.06; 362/249.16; 362/407

(58) Field of Classification Search ..... 411/378–426; 248/71, 50, 175, 218, 218.1, 218.2, 302, 248/74.1–74.5; 362/84, 396, 404, 407, 457, 362/249, 252, 311.02, 345, 218, 249.02, 362/612, 555, 800
See application file for complete search history.

(56) References Cited

U.S. PATENT DOCUMENTS 1,141,316 A * 6/1915 Cockrell ..... 248/61
1,753,013 A * 4/1930 Lindmark ..... 174/158 R
1,808,328 A * 6/1931 Thomson ..... 248/74.1
1,895,656 A * 1/1933 Gadke ..... 248/229.26
2,229,129 A * 1/1941 Riegelman ..... 248/62
3,596,859 A * 8/1971 MacDonald ..... 248/214
3,605,200 A * 9/1971 Vallinotto et al. ..... 24/20 TT
3,925,851 A * 12/1975 Bevans ..... 24/20 TT
D247,216 S * 2/1978 Mathews ..... D8/356
4,114,829 A * 9/1978 Boehler ..... 242/157 R
4,131,867 A * 12/1978 Quiogue ..... 336/65
4,856,739 A * 8/1989 Takikawa ..... 248/74.2
5,141,192 A * 8/1992 Adams ..... 248/231.81
5,460,274 A * 10/1995 Kramer ..... 211/17
5,613,656 A * 3/1997 Protz, Jr. ..... 248/74.2
6,182,933 B1 * 2/2001 Rapp ..... 248/231.81
D470,034 S * 2/2003 Wu et al. ..... D8/356
6,644,836 B1 * 11/2003 Adams ..... 362/396
6,802,480 B1 * 10/2004 Martello ..... 248/63
D546,170 S * 7/2007 Adams ..... D8/367
7,318,568 B2 * 1/2008 Barouta ..... 248/95

* cited by examiner

*Primary Examiner* — Anabel Ton
*Assistant Examiner* — Danielle Allen
(74) *Attorney, Agent, or Firm* — Albert W Davis, Jr

(57) ABSTRACT

The invention is a decorative light hanger which is used in mounting the lights to a structure. The hanger has a rigid corkscrew, helix or spiral which has slots between the revolutions of the spiral to allow the decorative light wires to be rotated through the slots until the wires are securely captured in the hole or opening created in the interior of the spiral.

4 Claims, 14 Drawing Sheets

METHOD FOR MOUNTING DECORATIVE LIGHTS

CROSS-REFERENCE TO RELATED APPLICATIONS

This application is a continuation-in-part of Ser. No. 11/476,963 filed Jun. 27, 2006 now abandoned by Michael Townes.

BACKGROUND OF THE INVENTION

Brackets, plastic hangers and various hangers have been devised to install and remove decorative lights on the interior and the exterior of buildings or other structures, such as a panel cut to resemble a tree, a deer, Santa Claus, the Easter Bunny, a witch, etc. One disadvantage of some of these mounting devices is that they are made of plastic. The sun's ultraviolet rays destroy the plastic, making it brittle and easy to break. Other devices do not hold decorative lights in place during high wind. Some devices compress or pinch wires to hold them in place, potentially damaging or shorting the decorative light wires causing fires. It is suggested that these devices be coated with an insulator if the hanger is made of metal to prevent shorting.

BRIEF SUMMARY OF THE INVENTION

The invention is a decorative light mounting hanger which is composed of a rigid cork screw, helix or spiral large enough to rotate decorative light wires through the slots created by the spiral until the wires are securely locked into the center hole on the interior of the spiral. The hanger has a shank that can have threads machined into it allowing the hanger to be screwed directly into a surface of the structure. The shaft can also be bent to create an eyelet that allows the hanger to be easily mounted on any type of material. The hangers are permanently mounted so that the lights can be easily installed and removed year after year. The hangers can be easily installed onto any material by using different types of screws, fasteners, nails or anchors.

Once the hangers are attached to a building or structure, the wire portion of the decorative lights can be easily rotated through the slots created by the rigid corkscrew, helix or spiral until the wire is supported inside the hole created by the rigid corkscrew, helix or spiral.

The twisting motion necessary to install the wire into the hanger is fast and effortless.

The hangers of the invention can be fashioned from non-corrosive or non-oxidizing, rigid metal that can withstand the elements for the life of the structure. The rigid corkscrew, helix or spiral design of the hangers allows the decorative lights to be securely fastened in the worst wind and weather conditions without the worry that the lights will come loose.

The hangers do not pinch or squeeze decorative light wires, therefore eliminating the danger of shorting the lights and potentially causing a fire. The hangers can be painted to match the building or structure that they are attached to.

DETAILED DESCRIPTION OF THE INVENTION

Figure 1:
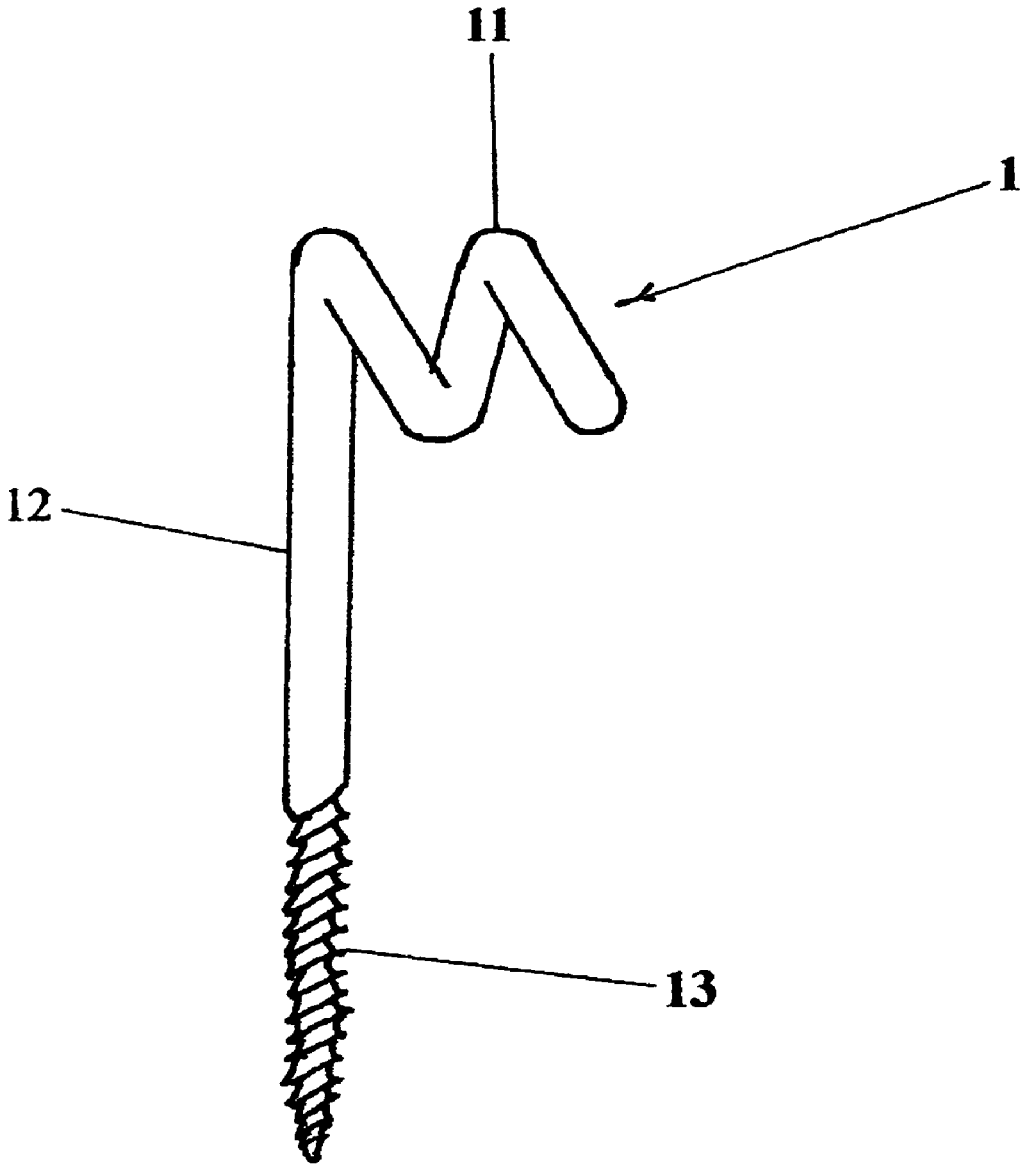
FIG. 1 is a side view of the first embodiment of the invention.

FIG. 1 shows the first embodiment of hanger 1 of the invention which has a rigid corkscrew, helix or spiral with multiple revolutions 11, shank 12 having a threaded portion 13. The unthreaded portion of the shank 12 spaces the spiral from a structure and allows the decorative light wires to be easily rotated through the spaces or slot between the portions of the revolution of the spiral during installation.

Figure 2:
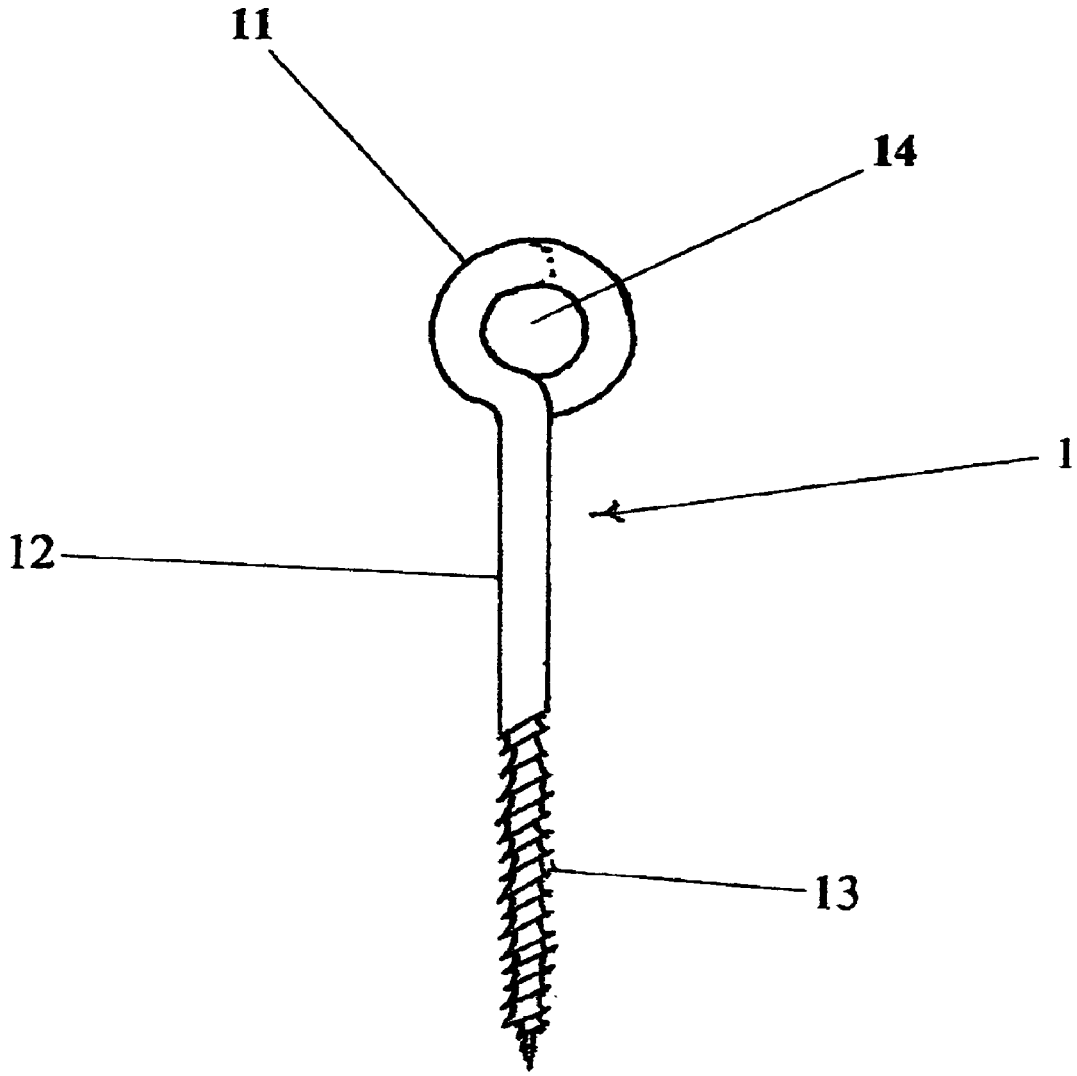
FIG. 2 is a rear view of the invention of FIG. 1.

FIG. 2 shows the elongated central hole or opening 14 formed along the longitudinal axis of the spiral 11. The decorative light wires are housed within the central hole 14 after installation thereby securing them in place.

Figure 3:
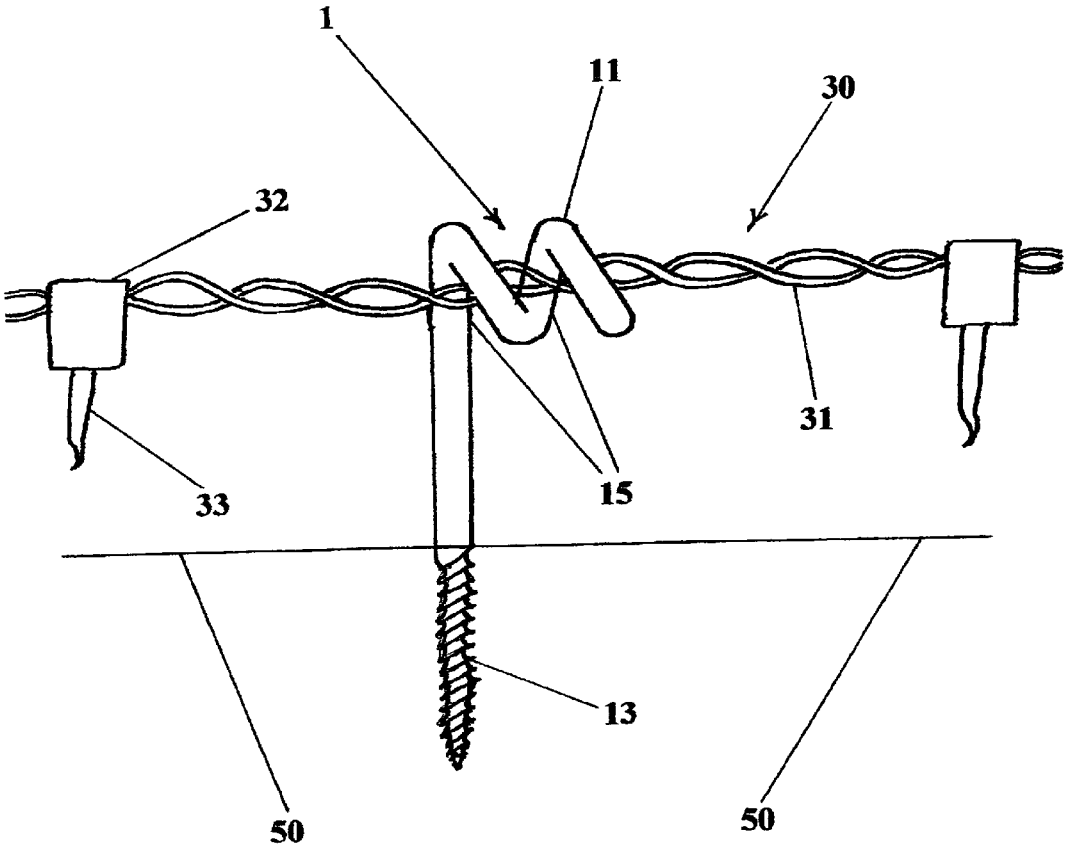
FIG. 3 is a side view of the first embodiment of the invention with the decorative lights installed.

FIG. 3 shows the decorative lights 30 passing through the hole or opening created by the spiral 11 and being captured by the spiral 11. The decorative lights 30 have wires 31, light sockets 32 and lights 33. To install the decorative lights, the decorative light wires 31 are rotated through the slots 15 created by the spaces between revolutions of the spiral 11 until the wires 31 are secured within the hole or opening formed by the spiral 11. To remove the decorative lights, the decorative light wires are simply rotated in the opposite direction through the slots 15 of the spiral 11. Line 50 denotes the plane of the surface on which the hangers 1 are mounted. The hangers 1 can be mounted in any orientation or direction.

Figure 4:
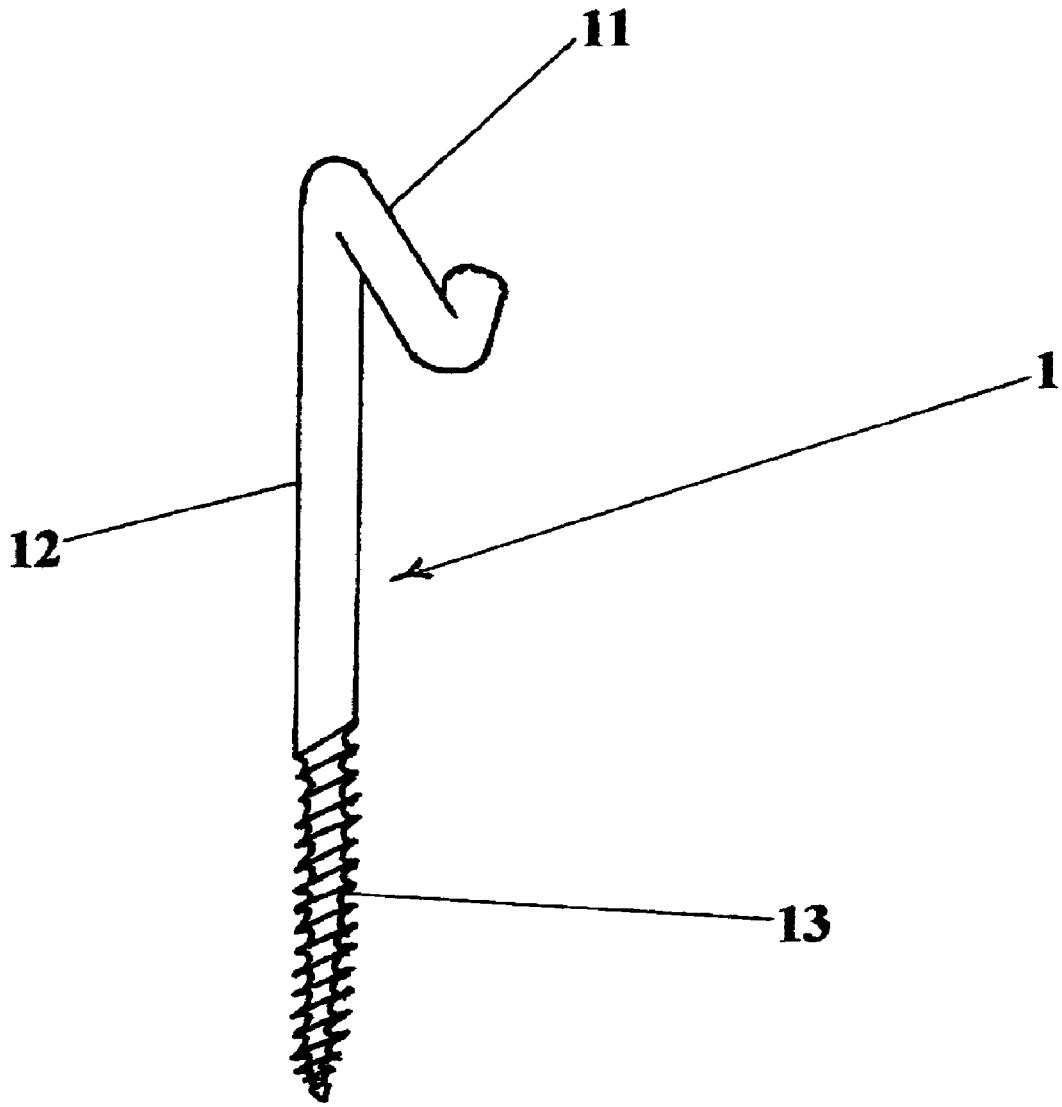
FIG. 4 is a side view of a second embodiment of the invention.

FIG. 4 shows the second embodiment of the invention in which the hanger 1 has a corkscrew, helix or spiral of fewer revolutions (one revolution). This embodiment achieves the same functionality as the first embodiment while making installation and removal of the decorative lights easier.

Figure 5:
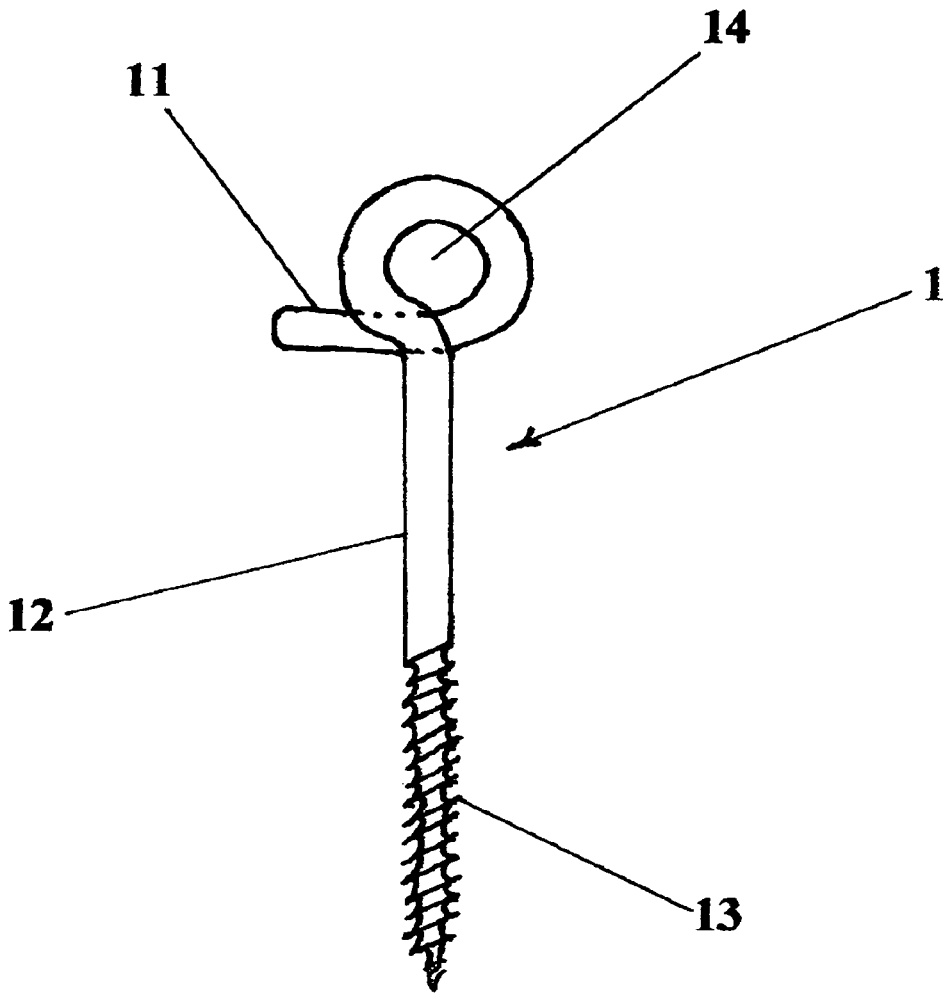
FIG. 5 is a rear view of the invention of FIG. 4.
Figure 12:
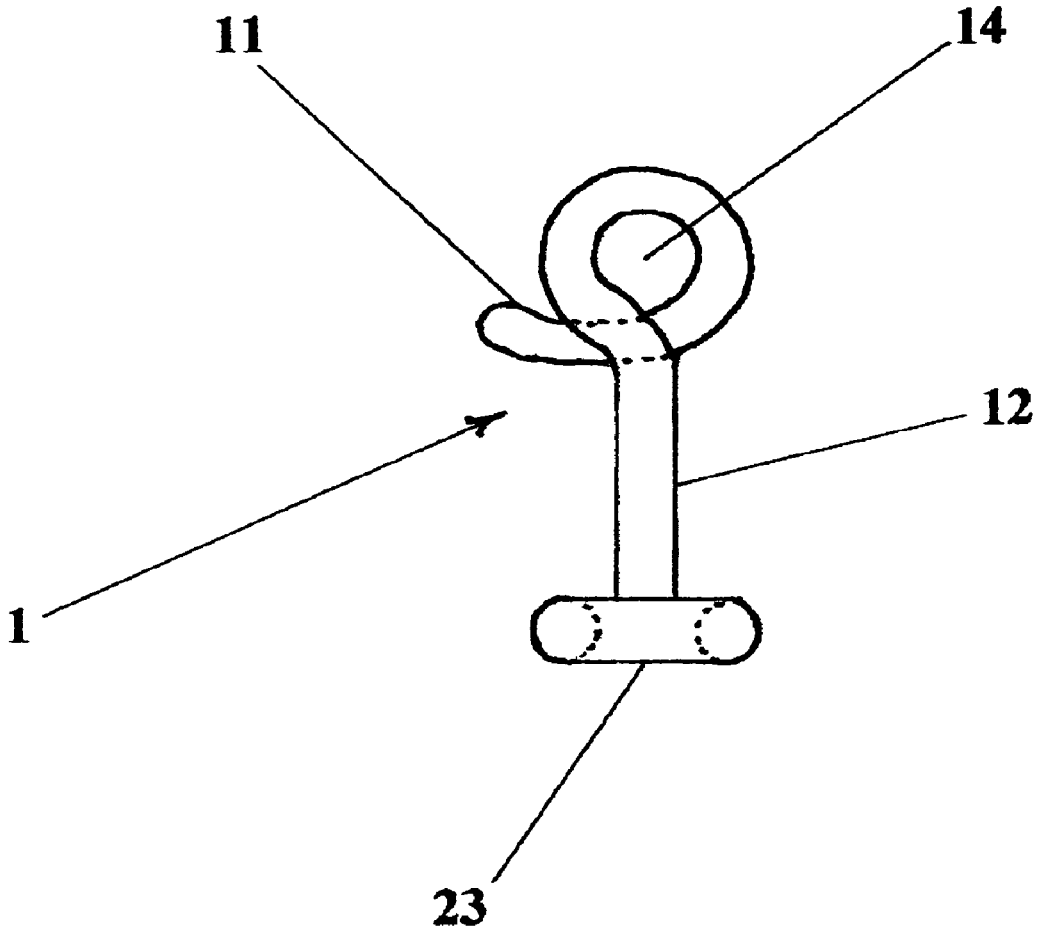
FIG. 12 is a rear view of the invention of FIG. 11.
Figure 13:
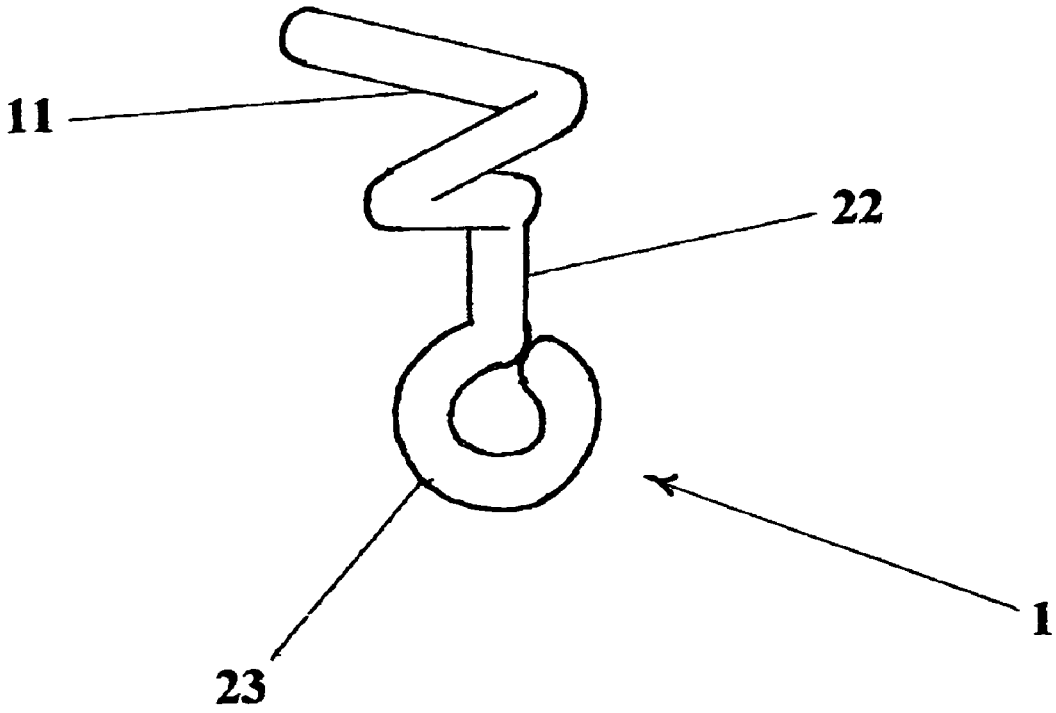
FIG. 13 is a top view of the invention of FIG. 11.

FIG. 5 shows a rear view of the second embodiment with opening 14 formed by the spiral 11. Preferably, the outer end of the spiral 11 has a portion that extends outwardly from the outer cylinder formed by the spiral as shown in this figure. This outward extension helps hold the wires during high wind conditions. This outward extension is especially useful where only one revolution is used on the hanger. This same feature is shown in FIGS. 12 and 13.

Figure 6:
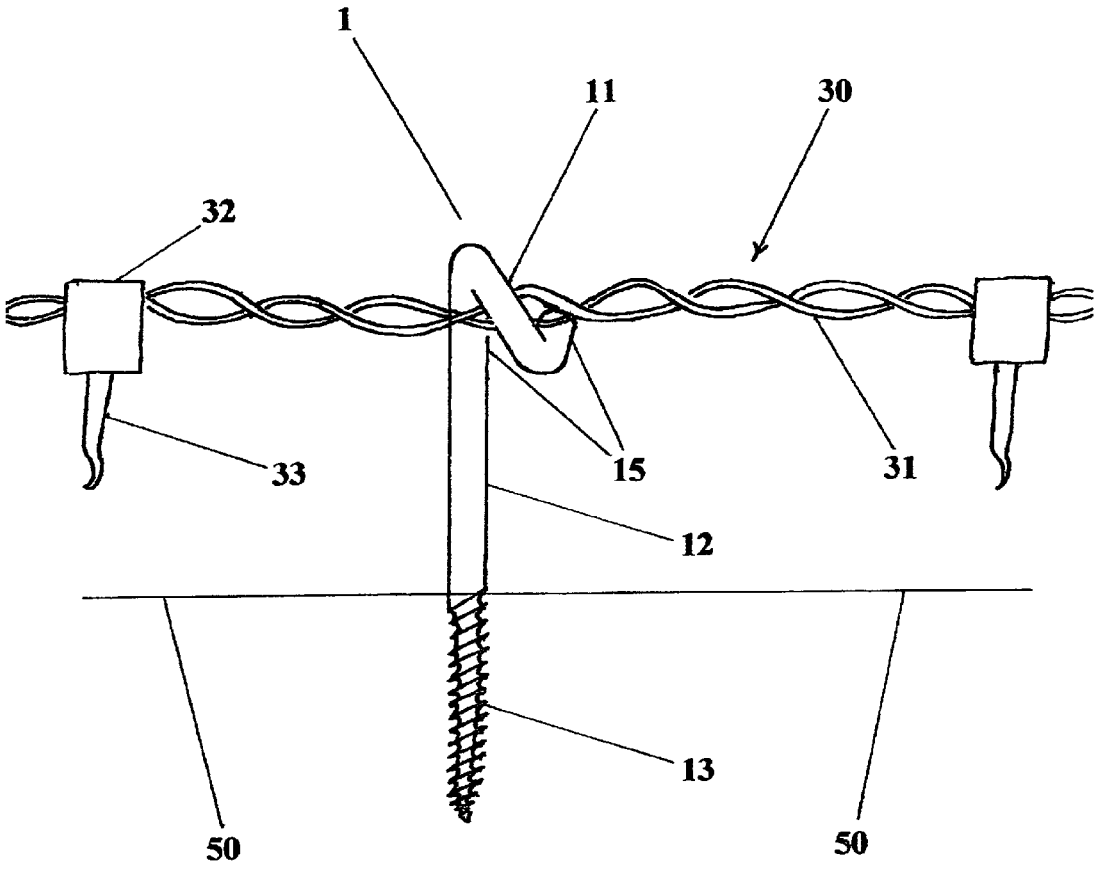
FIG. 6 is a side view of the second embodiment of the invention with the decorative lights installed.

FIG. 6 shows the decorative lights 30 passing through the hole or opening 14 created by the spiral 11 and being captured by the spiral 11. The decorative lights 30 have wires 31, light sockets 32 and lights 33. To install the decorative lights, the decorative light wires 31 are rotated through the slots 15 created by the spaces between revolutions of the spiral 11 until the wires 31 are secured within the hole or opening 14 formed by the spiral 11. To remove the decorative lights, the decorative light wires are simply rotated in the opposite direction through the slots 15 of the spiral 11. Line 50 denotes the plane of the surface on which the hangers 1 are mounted. The hangers 1 can be mounted in any orientation or direction.

Figure 7:
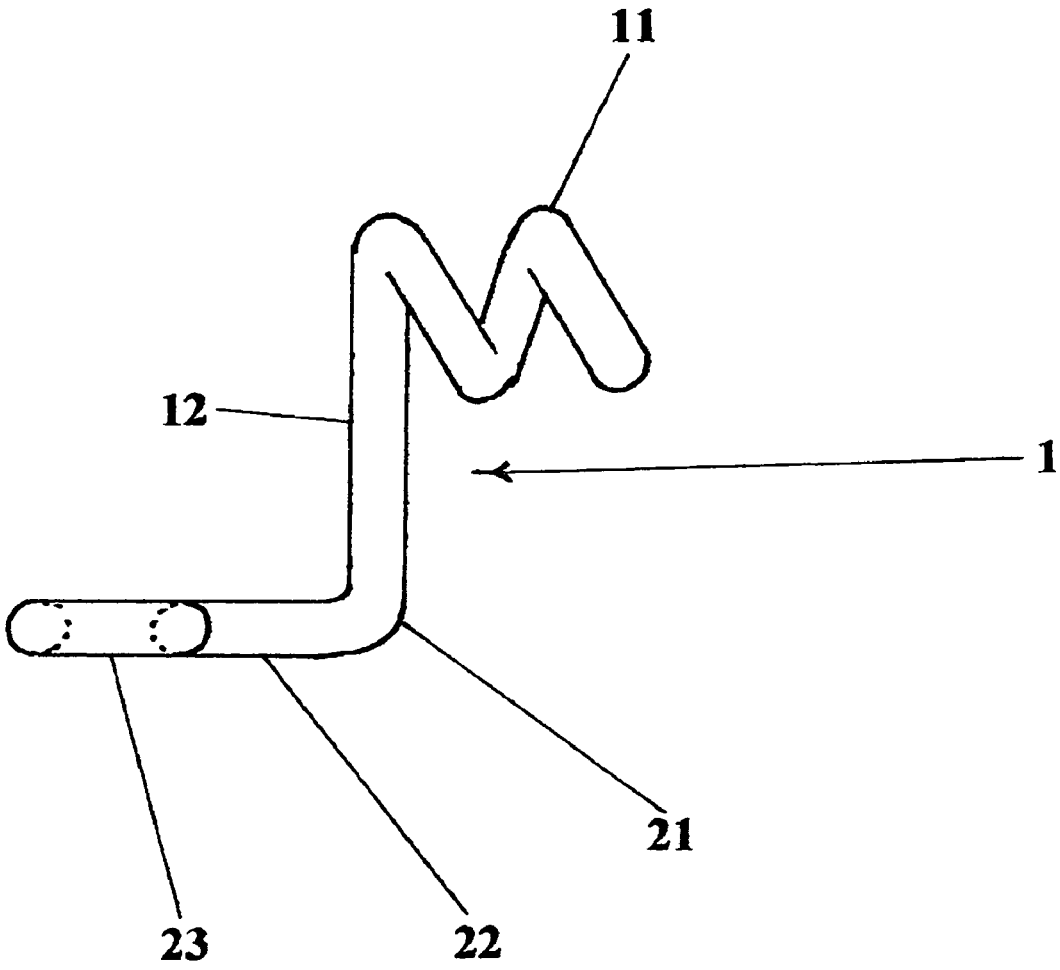
FIG. 7 is a side view of a third embodiment of the invention.

FIG. 7 shows the third embodiment of the invention in which the hanger 1 has a different design for mounting the hanger on a structure. This design has a shank 12 with a right angle bend 21, an extended shank portion 22 and an eye or loop 23. The shank 12 has a right angle bend at the point where the screw threads began in the first embodiment. The shank 12 then extends outwardly at 22 and has the eye 23 at the end. The eye 23 allows the hanger to be attached to the structure using wood screws, metal screws, masonry screws, nails, anchors or other types of fasteners. This design allows the hanger to be mounted on all types of materials.

Figure 8:
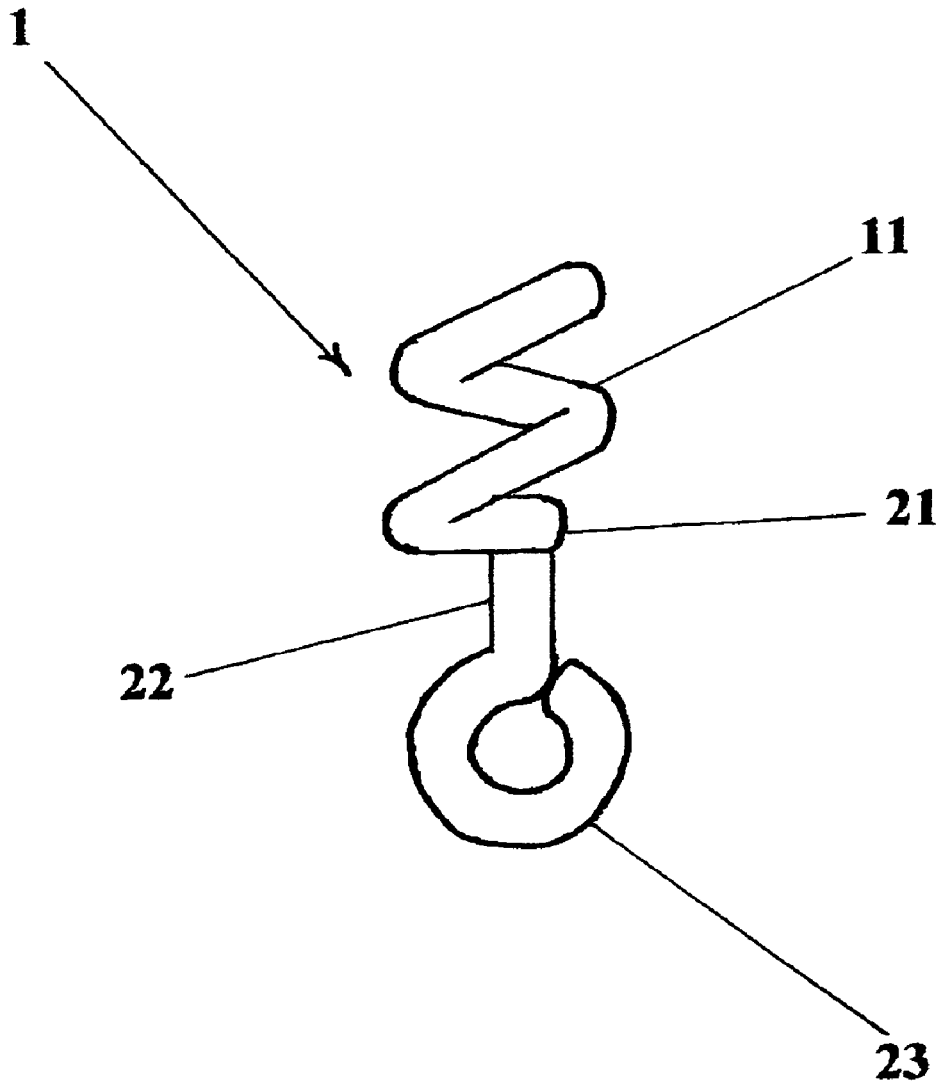
FIG. 8 is a top view of the invention of FIG. 7.

FIG. 8 shows a top view of the hanger with the extended shank portion 22 and the eye 23.

Figure 9:
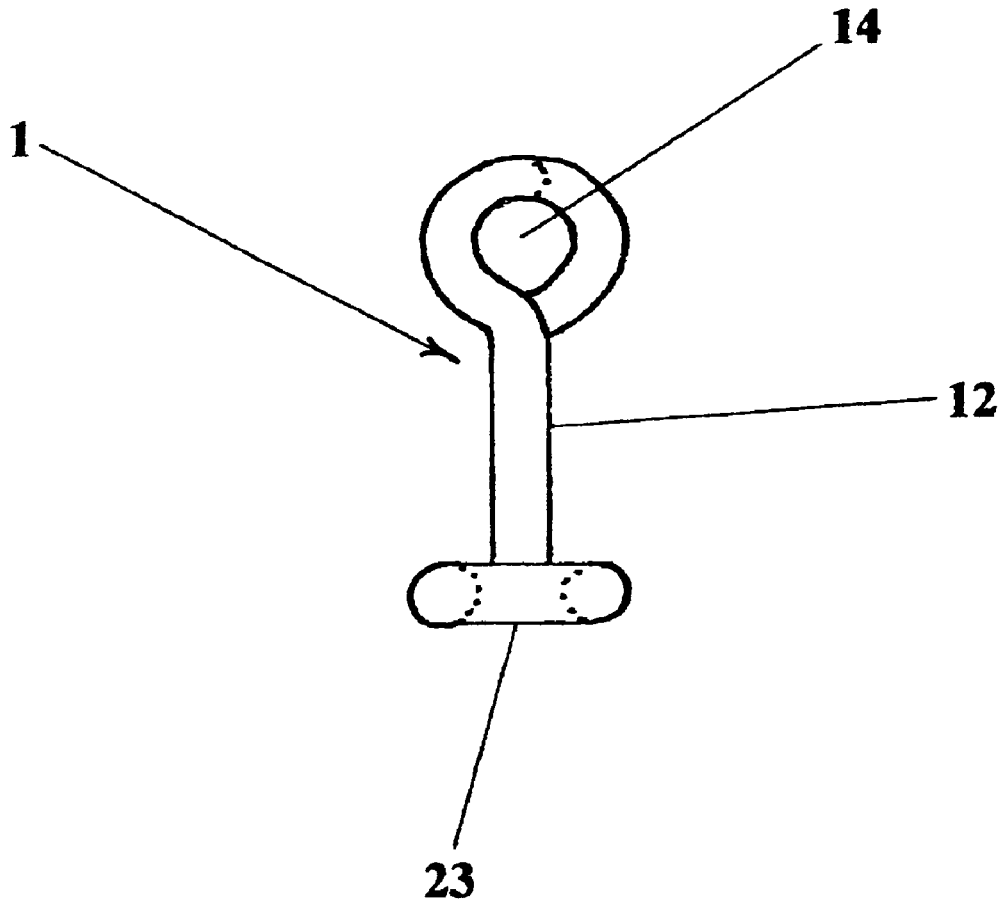
FIG. 9 is a rear view of the invention of FIG. 7.

FIG. 9 shows a rear view of the hanger 1 with the elongated opening 14, the shank 12 and the eye 23.

Figure 10:
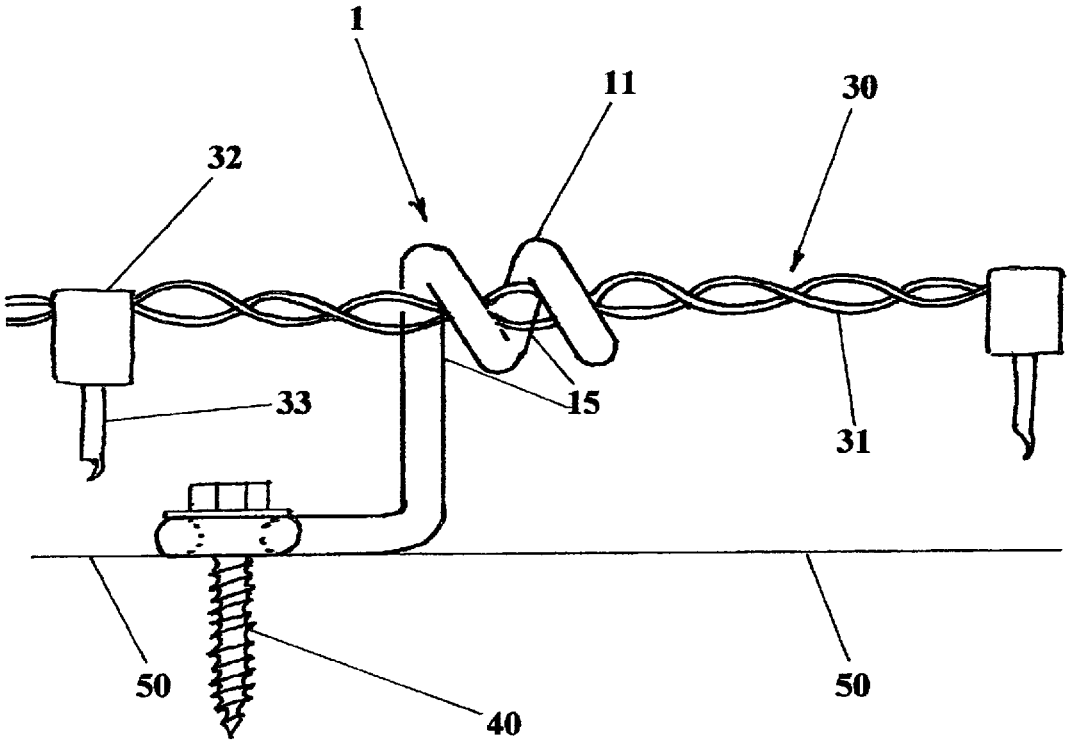
FIG. 10 is a side view of the third embodiment of the invention with the decorative lights installed.

FIG. 10 shows the decorative lights 30 passing through the hole or opening 14 created by the spiral 11 and being captured by the spiral 11. The decorative lights 30 have wires 31, light sockets 32 and lights 33. To install the decorative lights, the decorative light wires 31 are rotated through the slots 15 created by the spaces between revolutions of the spiral 11 until the wires 31 are secured within the hole or opening 14 formed by the spiral 11. To remove the decorative lights, the decorative light wires are simply rotated in the opposite direction through the slots 15 of the spiral 11. Line 50 denotes the plane of the surface on which the hangers 1 are mounted. The hangers 1 can be mounted in any orientation or direction. In this example, a screw 40 is shown mounting the hanger 1 to a surface.

Figure 11:
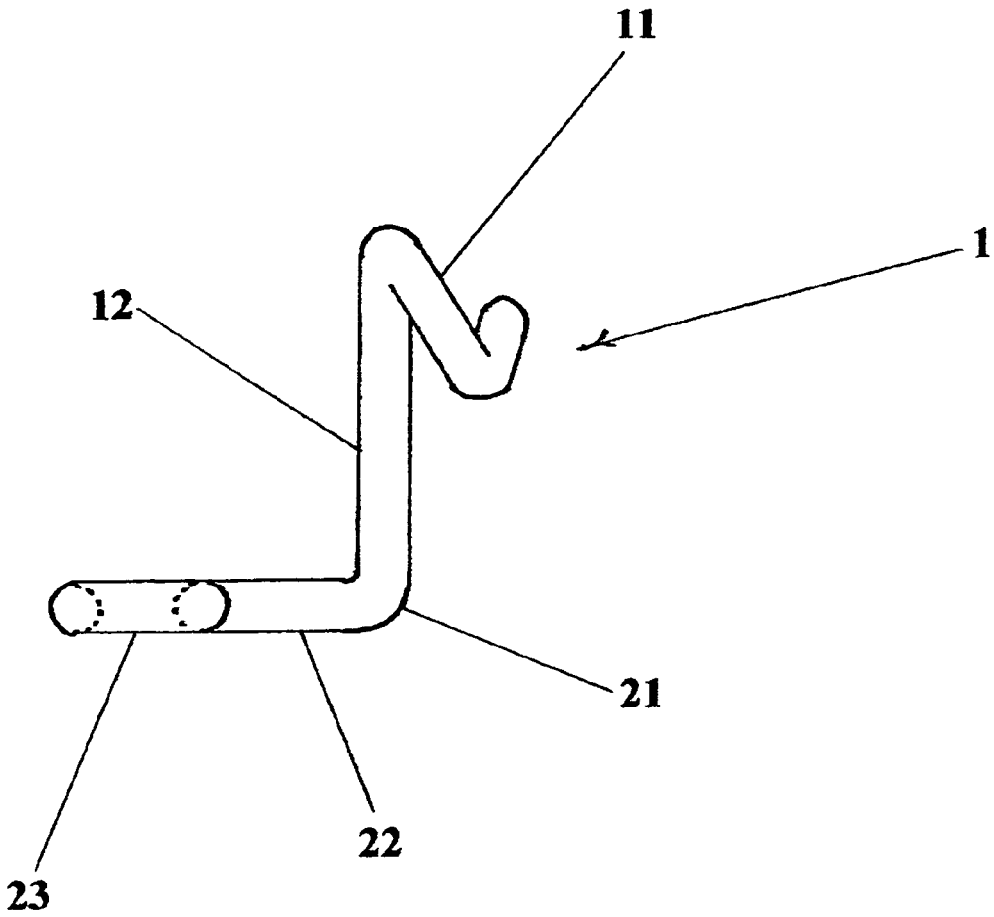
FIG. 11 is a side view of a fourth embodiment of the invention.

FIG. 11 shows the fourth embodiment of the invention in which the hanger 1 has a corkscrew, helix or spiral of fewer revolutions (one revolution). This embodiment achieves the same functionality as the first embodiment while making installation and removal of the decorative lights easier. This embodiment which is mounted like the third embodiment can also be used on many different surfaces.

FIG. 12 shows a rear view of the hanger 1 with the elongated opening 14, the shank 12 and the eye 23.

FIG. 13 shows a top view of the hanger with the extended shank portion 22 and the eye 23.

Figure 14:
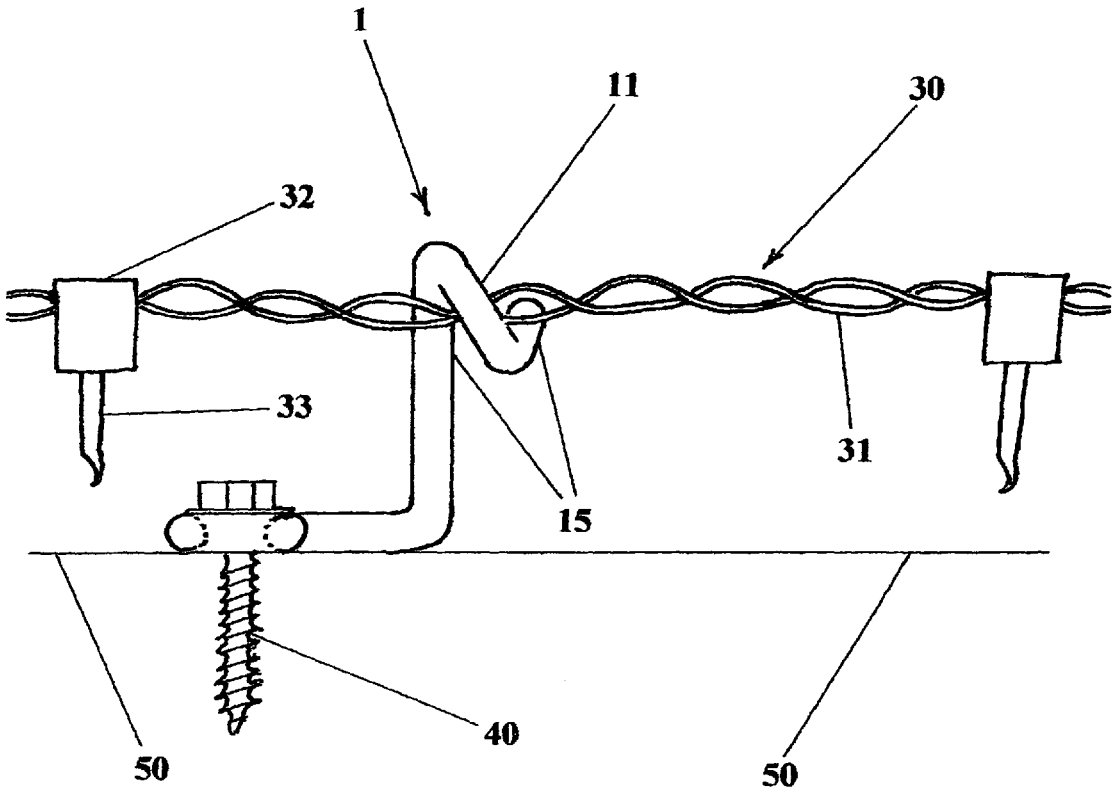
FIG. 14 is a side view of the fourth embodiment of the invention with the decorative lights installed.

FIG. 14 shows the decorative lights 30 passing through the hole or opening 14 created by the spiral 11 and being captured by the spiral 11. The decorative lights 30 have wires 31, light sockets 32 and lights 33. To install the decorative lights, the decorative light wires 31 are rotated through the slots 15 created by the spaces between revolutions of the spiral 11 until the wires 31 are secured within the hole or opening 14 formed by the spiral 11. To remove the decorative lights, the decorative light wires are simply rotated in the opposite direction through the slots 15 of the spiral 11. Line 50 denotes the plane of the surface on which the hangers 1 are mounted. The hangers 1 can be mounted in any orientation or direction. In this example, a screw 40 is shown mounting the hanger 1 to a surface.

As an example of the specifications for a hanger, such as that of FIG. 1, the following is provided. The stock is circular, 8 Gauge, Grade 304 Stainless Steel. Each spiral revolution has a length of ½ inch with an outer diameter of ½ inch and an inner diameter of ⅜ inch forming the hole or opening. The length of the shank is 2 inches with the threaded portion being ¾ inch.

While the disclosure has been described with reference to several embodiments, it will be understood by those skilled in the art that various changes may be made and equivalents may be substituted for elements thereof without departing from the scope of the disclosure.

Such variations could include the stock being a square, pentagon, hexagon, octagon, etc. in cross-section.

In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

I claim:

1. A method of hanging decorative lights on a structure, the decorative lights having a wire and bulbs, the method comprising the following steps, providing a wire hanger, the hanger having a means to mount the hanger to the structure and a wire holding means, the wire holding means having a spiral portion, the spiral portion having at least one spiral revolution, the spiral portion forming a longitudinal axis, the spiral portion forming two open end portions and forming a central opening along the longitudinal axis of the spiral portion, the spiral portion creating a slot along the spiral portion, the hanger being made from metal and being substantially round in cross-section, mounting the hanger to the structure by puncturing the structure using the mounting means and orienting the mounting means so that the longitudinal axis of the spiral portion is oriented along the surface of the structure, and hanging the lights on the structure by moving the wire within the slot of the spiral portion so that the wire is securely contained within the central opening of the spiral portion and passes through both of the open end portions of the spiral portion and lies along the longitudinal axis of the spiral portion.

2. The method of claim 1 including the following step not flexing the mounting means during the mounting.

3. The method of claim 1 in which the mounting means is a threaded portion of the hanger.

4. The method of claim 1 in which the spiral portion having a far end portion opposite to the mounting means through which the wire passes into the slot, the far end portion extending outwardly from the spiral portion.

* * * * *